US006598958B2

(12) United States Patent
Aizawa et al.

(10) Patent No.: US 6,598,958 B2
(45) Date of Patent: Jul. 29, 2003

(54) LIQUID EJECTOR

(75) Inventors: Jyunichi Aizawa, Tokyo (JP); Hiroshi Fukumoto, Tokyo (JP); Munehisa Takeda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/845,270

(22) Filed: May 1, 2001

(65) Prior Publication Data

US 2002/0063751 A1 May 30, 2002

(30) Foreign Application Priority Data

Nov. 30, 2000 (JP) ..... 2000-364623

(51) Int. Cl.[7] ..... B41J 2/135
(52) U.S. Cl. ..... 347/46
(58) Field of Search ..... 347/46; 239/102.2

(56) References Cited

U.S. PATENT DOCUMENTS 4,751,534 A 6/1988 Elrod et al.
5,686,945 A 11/1997 Quate et al.
6,154,235 A 11/2000 Fukumoto et al.
6,182,907 B1 2/2001 Nakagawa et al.

FOREIGN PATENT DOCUMENTS

| | | | | |
|---|---|---|---|---|
| JP | 404168050 | * | 6/1992 | ..... 347/46 |
| JP | 6-91890 | | 4/1994 | |
| JP | 6-35177 | | 5/1994 | |
| JP | 6-238884 | | 8/1994 | |
| JP | 10-278253 | | 10/1998 | |

OTHER PUBLICATIONS

Hiroshi Fukumoto, et al., IS&Ts NIP 15: 1999 International Conference on Digital Printing Technologies, pp. 310–314, "Printing with Ink Mist Ejected by Ultrasonic Waves", 1999.

* cited by examiner

*Primary Examiner*—John Barlow
*Assistant Examiner*—Michael S Brooke
(74) *Attorney, Agent, or Firm*—Oblon, Spivak, McClelland, Maier & Neustadt, P.C.

(57) ABSTRACT

A liquid ejector including at least one acoustic conductor for propagating acoustic wave, the at least one acoustic conductor including a first surface which is provided with the acoustic wave from the outside and an outer surface configured to focus the acoustic wave at a focal point, and a supplying path for supplying liquid to be ejected from the outside of the acoustic conductor to the focal point.

19 Claims, 11 Drawing Sheets

LIQUID EJECTOR

BACKGROUND OF THE INVENTION

1. Field of the Invention

The present invention relates to an apparatus for ejecting liquid, which is applicable to, for example, an ink jet type print head and a spraying/coating apparatus.

2. Description of the Background Art

FIG. 18 is a sectional view showing a structure of a conventional liquid ejector, which is introduced in Japanese Patent Application Laid-Open No. 10-278253, for example. A cavity is provided on an ink tank 10 for storing ink 30. The cavity communicates with an opening 19 opened on the ink tank 10 and has a parabolic reflecting wall 11 as an inner wall which locates a focal point 12 in the vicinity of the opening 19. The cavity is also opened at the opposite side of the opening 19, where a piezoelectric transducer 20 is provided to vibrate the ink 30. The vibration is carried out by connecting an ac source 25 between a surface of a piezoelectric vibration excitor 29 forming the piezoelectric transducer 20 and an electrode 21 for preventing leakage of the ink 30 from the cavity through wirings 24 and 23, respectively.

In such a liquid ejector, the vibration of the piezoelectric transducer 20 provides acoustic wave 26 for the ink 30 stored in the cavity in almost plane form. The acoustic wave 26 propagates within the ink 30 and reaches the reflecting wall 11 to be focused onto the focal point 12. Since the focal point 12 is positioned near the opening 19, the acoustic energy of the ink 30 at this point increases in density so that an ink droplet 31 is ejected.

A leading path 13 which supplies the ink 30 into the cavity is provided on the reflecting wall 11 and near the piezoelectric transducer 20 so as not to impair the function of reflecting the acoustic wave 26.

However, this arrangement easily causes an air bubble 30*a* to remain in the cavity, especially on the opposite side of the leading path 13 near the piezoelectric transducer 20 when the ink 30 is supplied from the leading path 13 into the cavity surrounded by the reflecting wall 11. The occurrence of the bubble 30*a* may impair the propagation of the acoustic wave 26 and the reflection at the reflecting wall 11 at the position, which may result in decrease in the acoustic energy at focusing. That is, it is a first problem that the presence of the bubble 30*a* makes it difficult to control a droplet to be ejected and worsens the ejection efficiency.

Since the focal point 12 is provided in the vicinity of the opening 19, the leading path 13 on the opposite side of the opening 19 is placed at a position where the reflecting wall 11 with a parabolic surface extends wide open. This causes a mechanism for supplying the ink to the leading path 13 to be provided outside the maximum diameter of the cavity, resulting in a second problem that is to be a factor of preventing miniaturization of the device.

SUMMARY OF THE INVENTION

A first aspect of the present invention is directed to a liquid ejector comprising at least one acoustic conductor for propagating acoustic wave including a first surface and an outer surface for reflecting the acoustic wave given to the first surface and focusing it onto a focal point. The liquid ejector further comprises a supplying path for supplying liquid to be ejected from the outside of the acoustic conductor to the focal point. The "outside of the acoustic conductor" indicates portions other than the acoustic conductor, and includes a form that the "outside" is surrounded by the acoustic conductor.

According to a second aspect of the present invention, in the liquid ejector of the first aspect, in cross section of the at least one acoustic conductor, the outer surface presents a parabola having a focus on the focal point, and the acoustic wave is supplied in parallel with an axis of the parabola.

According to a third aspect of the present invention, in the liquid ejector of the first aspect, in cross section of the at least one acoustic conductor, the outer surface presents an ellipse having a first focus on the focal point, and the acoustic wave is supplied radially at a second focus of the ellipse.

According to a fourth aspect of the present invention, in the liquid ejector of the first aspect, the supplying path is arranged outside the outer surface.

According to a fifth aspect of the present invention, in the liquid ejector of the fourth aspect, the at least one acoustic conductor includes a plurality of acoustic conductors, and the supplying path is used in common for the plurality of acoustic conductors.

According to a sixth aspect of the present invention, in the liquid ejector of the fifth aspect, the supplying path extends in a direction that the plurality of acoustic conductors are arranged.

According to seventh and tenth aspects of the present invention, in the liquid ejector of the fourth or ninth aspect, the at least one acoustic conductor further comprises a second surface arranged closer to the first surface than the focal point, a boundary between the liquid to be ejected and the second surface is perpendicular to a traveling direction of the acoustic wave reflected at the outer surface.

According to eighth and eleventh aspects of the present invention, in the liquid ejector of the seventh or tenth aspect, in cross section of the at least one acoustic conductor, the outer surface presents a parabola having a focus on the focal point, and the second surface presents an arc shape being convex to the first surface.

According to a ninth aspect of the present invention, in the liquid ejector of the first aspect, the at least one acoustic conductor further comprises an inner surface separated from the outer surface, and the supplying path is formed by the inner surface.

According to a twelfth aspect of the present invention, in the liquid ejector of the eleventh aspect, in the cross section where the outer surface presents the parabola, an intersection of the first surface and the parabola is taken as a first intersection, an intersection of the arc and a line connecting the first intersection and the focus of the parabola is taken as a second intersection, and the inner surface is positioned closer to the axis than a line passing through the second intersection in parallel with the axis.

According to a thirteenth aspect of the present invention, in the liquid ejector of the ninth aspect, the outer surface presents a parabola in cross section having a focus on the focal point, and the inner surface is provided in the vicinity of an axis of the parabola.

According to a fourteenth aspect of the present invention, in the liquid ejector of the thirteenth aspect, the inner surface presents a line in cross section of the at least one acoustic conductor.

According to a fifteenth aspect of the present invention, in the liquid ejector of the ninth aspect, the at least one acoustic conductor is liquid being filled in between a body surrounding the at least one acoustic conductor and the supplying path.

According to a sixteenth aspect of the present invention, the liquid ejector of the first or fourteenth aspect further comprises a protecting member being in contact with the outer surface of the at least one acoustic conductor and having an acoustic impedance larger than that of the at least one acoustic conductor.

According to a seventeenth aspect of the present invention, in the liquid ejector of the sixteenth aspect, the protecting member is thicker than the wavelength of the acoustic wave in the at least one acoustic conductor.

According to an eighteenth aspect of the present invention, in the liquid ejector of the first aspect, the outer surface has a diameter decreasing from the focal point toward an opening for ejecting the liquid to be ejected.

In the liquid ejector of the first to third aspects, focusing of the acoustic wave results in increase in the acoustic energy to eject the liquid to be ejected. Further, there is no need to provide an inner wall combining the function of storing the liquid to be ejected with that of reflecting the acoustic wave, so that the liquid to be ejected is not supplied into a cavity formed by such an inner wall. Accordingly, an air bubble hardly appears in the liquid to be ejected.

In the liquid ejector of the fourth aspect, liquid is provided from the outside of the outer surface, which makes it easy to form a supplying path where an air bubble hardly appears.

The liquid ejector of the fifth aspect allows a general supply of the liquid to be ejected to the plurality of acoustic conductors. Further, the components are used in common, which results in reduction in the number of parts and easy assemble. Therefore, the cost can be reduced.

The liquid ejector of the sixth aspect is capable of supplying the liquid to be ejected to the plurality of acoustic conductors rapidly and smoothly without an air bubble remained.

In the liquid ejector of the seventh or tenth aspect, the reflection of the acoustic wave is small at the boundary between the acoustic conductor and the liquid. Thus, the focusing efficiency of the acoustic energy in the liquid can be increased.

In the liquid ejector of the eighth or eleventh aspect, the boundary between the acoustic conductor and the liquid is perpendicular to the traveling direction of the reflected acoustic wave, resulting in minimization of the reflection at the boundary. Moreover, the acoustic wave is in phase at the focal point, so that the Focusing efficiency of the acoustic energy in the liquid to be ejected is increased.

In the liquid ejector of the ninth aspect, the liquid to be ejected is supplied from the inner surface of the acoustic conductor. This allows to avoid size increase of the liquid ejector which will be caused by providing a liquid supplying mechanism. In addition, its weight can be reduced.

In the liquid ejector of the twelfth aspect, every acoustic wave reflected at the outer surface can be made incident perpendicularly to the liquid.

In the liquid ejector of the thirteenth aspect, the supplying path is provided in the vicinity of the axis of the parabola which makes a minor contribution to the reflection of the acoustic wave.

In the liquid ejector of the fourteenth aspect, since the supplying path has a simple form, an air bubble is hardly produced.

In the liquid ejector of the fifteenth aspect, the acoustic impedance of the liquid to be ejected and that of the acoustic conductor can be approximated to each other, so that the ejection efficiency is improved.

The liquid ejector of the sixteenth aspect maintains the function of the outer surface of reflecting the acoustic wave propagating in the acoustic conductor while preventing the function of the acoustic conductor of propagating the acoustic wave from outside disturbances.

The liquid ejector of the seventeenth aspect suppresses transmission of the acoustic wave given to the first surface into the protecting member from the outer surface.

The liquid ejector of the eighteenth aspect is capable of further reducing the focusing diameter to eject the liquid to be ejected even when the acoustic wave has a long wavelength in the acoustic conductor and a large focusing diameter at the focal point.

An object of the present invention is to provide a liquid ejector in which the arrangement of a leading path for supplying liquid such as ink has been devised in order to solve the above first or second problem.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
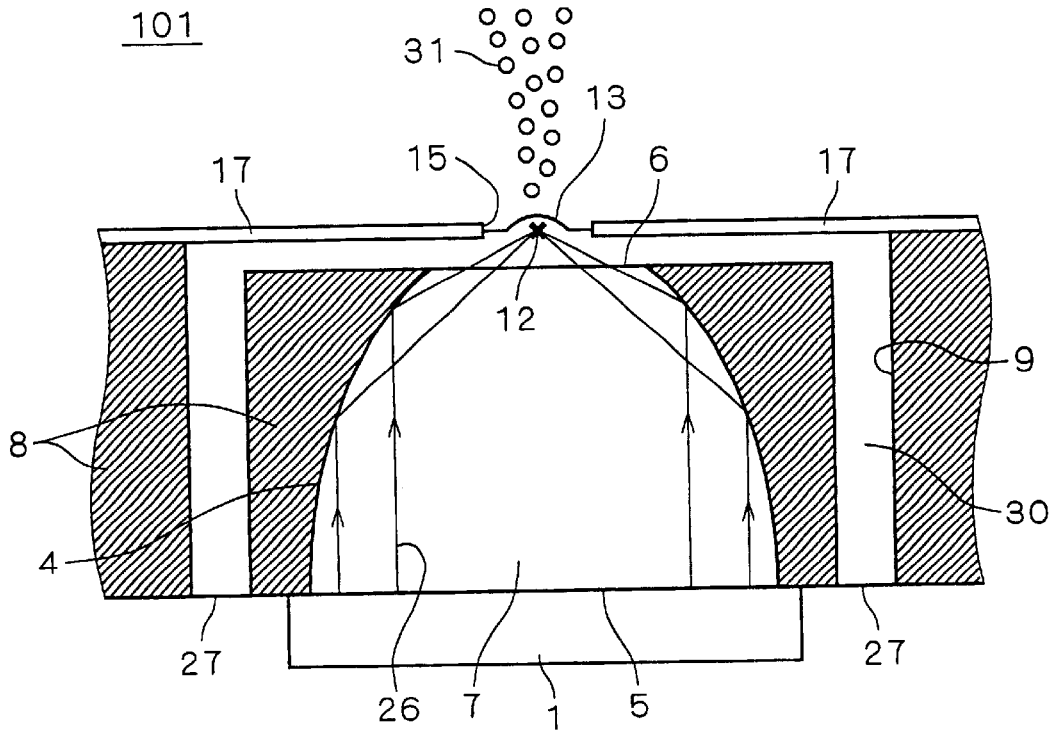
FIG. 1 is a sectional view showing a structure of a liquid ejector according to a first embodiment of the present invention.

FIG. 1 is a sectional view showing a structure of a liquid ejector 101 according to the present embodiment. An acoustic conductor 7 comprises a first surface 5 and a second surface 6 which are opposed to each other. A vibration excitor 1 is provided on the first surface 5. The piezoelectric transducer 20 explained in Description of the Background Art, for example, may be employed as the vibration excitor 1. The vibration excitor 1 provides the first surface 5 with the acoustic wave 26 in almost plane form.

The acoustic conductor 7 further comprises an outer surface 4 for bridging the first surface 5 and the second surface 6. The outer surface 4 has the function of reflecting the acoustic wave 26 given to the first surface 5 by the vibration excitor 1 and propagated inside the acoustic conductor 7, and focusing it onto the vicinity of the second surface 6.

The first surface 5 is, for example, in parallel with and larger than the second surface 6. The outer surface 4 presents a parabola in cross section whose axis is a line perpendicular to the first surface 5 and the second surface 6. If the first surface 5 and the second surface 6 are circular, for example, the outer surface 4 presents a paraboloid of revolution. If the first surface 5 and the second surface 6 extend in a direction having a component perpendicular to the sheet of drawing, the outer surface 4 extends in that direction while having a surface presenting a parabola in the cross section shown in FIG. 1. For instance, the parabola of the outer surface 4 shown in the cross section has the focal point 12 above the second surface 6. In other words, the second surface 6 is closer to the first surface 5 than the focal point 12.

Ink 30, liquid to be ejected, is supplied onto the second surface 6 through a supplying path 9, and its liquid level 13 is set separately from the second surface 6 more than the focal point 12. Thus, when providing the acoustic wave 26 which travels in parallel with the axis of the parabola shown in the cross section of the outer surface 4, it is reflected at the outer surface 4 and focused onto the focal point 12 existing in the ink 30. Accordingly, similarly to the background art, the acoustic wave 26 is focused and the acoustic energy of the ink 30 is increased, thereby ejecting an ink droplet 31.

In the present embodiment, the acoustic wave 26 is propagated by the acoustic conductor 7, not by the ink 30, different from the background art. Therefore, it is not required to provide an inner wall combining the function of storing the ink 30 with that of reflecting the acoustic wave 26. Thus, the ink 30 is not supplied into a cavity formed by such an inner wall, so that an air bubble hardly appears in the ink 30. Consequently, the first problem can be solved.

The supplying path 9 is provided, for example, from the outside of the acoustic conductor 7, i.e., the opposite side of the acoustic conductor 7 with respect to the outer surface 4 (taken as "the outside of the acoustic conductor" in the present specification), to the vicinity above the second surface 6, e.g., the focal point 12. The supplying path 9 is formed in a body 8 covering the acoustic conductor 7 and leads the ink 30 from a position lower than the second surface 6. FIG. 1 shows an embodiment in that the supplying path 9 includes an opening 27 exposed in the vicinity of the first surface 5. The ink 30 is supplied to the opening 27 by a supplying mechanism not shown.

When supplied through the opening 27 in the condition that air exists in the supplying path 9, the ink 30 serves to exhaust the air existing in the supplying path 9 while moving its liquid level 13 from the first surface 5 side to the second surface 6 side. Accordingly, the ink 30 can be supplied to the focal point 12 without occurrence of an air bubble.

It is preferable that the acoustic conductor 7 be solid so as not to mix with the ink 30. It is also preferable that the acoustic wave 26 propagate with a low attenuation so that the ejection efficiency should not be reduced. Further, the acoustic impedance of the acoustic conductor 7 is preferably set close to that of the ink 30 in order to improve the transmission efficiency of the acoustic wave 26 on the second surface 6 where the ink 30 comes into contact with the acoustic conductor 7. In the case that the acoustic conductor 7 and the body 8 are in contact as shown in FIG. 1, it is preferable that there should be a significant difference in the acoustic impedance between the body 8 and the acoustic conductor 7, and that the body 8 should be thicker than the wavelength of the acoustic wave 26 in the acoustic conductor 7 in order to reduce the transmittance of the acoustic wave 26 from the acoustic conductor 7 into the body 8 and to have the acoustic wave 26 reflected greatly at the outer surface 4.

The acoustic wave 26 may generate heat when attenuating in the acoustic conductor 7, though by a small amount. From this point of view, it is preferable to use polyimide of high heat resistance or thermosetting epoxy resin as a material of the acoustic conductor 7. In the case of employing water soluble ink 30, for example, rubber is also preferable for the acoustic conductor 7 for having substantially the same acoustic impedance as water.

By covering the acoustic conductor 7, the body 8 also functions as a protective material for protecting the function of the acoustic conductor 7 of propagating the acoustic wave 26 against outside disturbances. Metal may be employed as a material of the body 8.

In order to maintain the liquid level 13 of the ink 30 and the focal point 12 with a certain space therebetween as well as to stabilize the ejection of the ink 30, it is preferable to provide a holding plate 17 for covering the supplying path 9 above the second surface 6. The holding plate 17 has an opening 15 above the second surface 6, performing the function of holding the liquid level 13. Preferably, the opening 15 has a diameter wide enough to hold the liquid level 13 by the surface extension of the ink 30 and sufficiently larger than the wavelength of the acoustic wave 26 so as not to prevent the focusing of the acoustic wave 26 onto the focal point 12.

In this case, it is preferable to provide a plurality of openings 27 in cross section as shown in FIG. 1. This is because supplying the ink 30 through one of the openings while sucking it through another one makes it more difficult to produce an air bubble.

Figure 2:
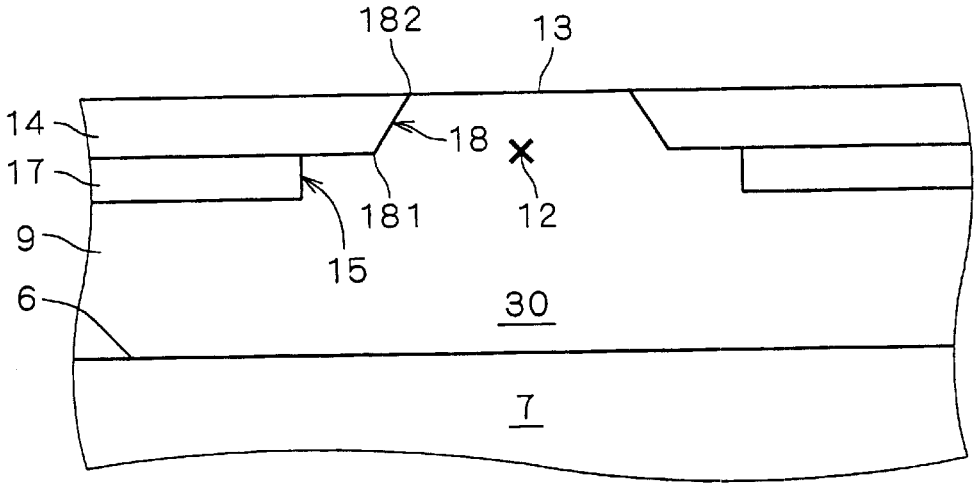
FIG. 2 is a sectional view showing a structure of a modification of the liquid ejector according to the first embodiment.

FIG. 2 is a sectional view showing a structure of a modification of the liquid ejector according to the first embodiment, in which the part above the second surface 6 of the liquid ejector 101 is magnified. A nozzle plate 14 is provided on the holding plate 17. The nozzle plate 14 has a nozzle hole 18 opened on the opening 15 having a diameter smaller than that of the opening 15. An inlet 181 of the nozzle hole 18 has a diameter, e.g., almost equal to the wavelength of the acoustic wave 26 in the ink 30, while an outlet 182 has a diameter, e.g., not larger than the wavelength. The center of the inlet 181 of the nozzle hole 18 is preferably positioned at the focal point 12.

Because of the presence of the nozzle hole 18, the acoustic wave 26 focused onto the inlet 181 is further concentrated by the nozzle hole 18, resulting in increase in the energy at the outlet 182. This increases the strength of the ejection of the ink droplet 31, so that the ejection efficiency is improved.

Second Preferred Embodiment

Figure 3:
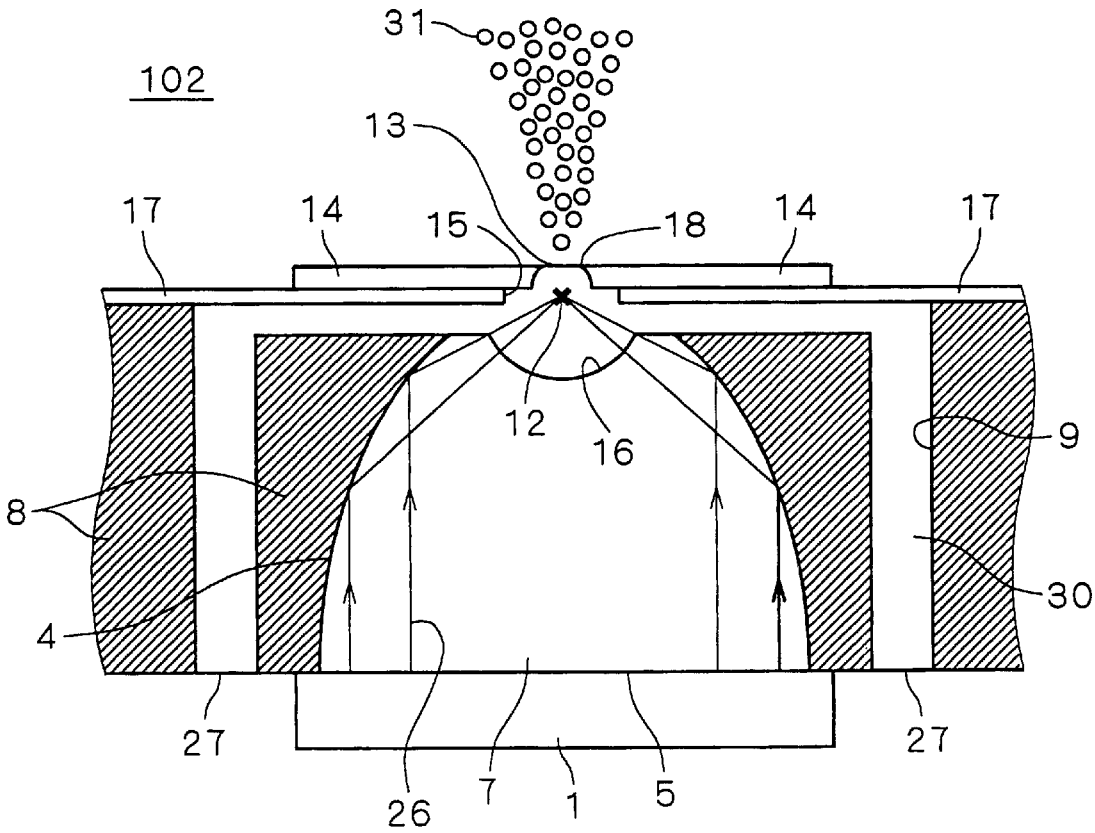
FIG. 3 is a sectional view showing a structure of a liquid ejector according to a second embodiment of the present invention.

FIG. 3 is a sectional view showing a structure of a liquid ejector 102 according to the present embodiment. The liquid ejector 102 comprises a second surface 16 instead of the second surface 6 in the structure of the modification of the liquid ejector 101 shown in FIG. 2. The focal point 12 is positioned above the second surface 16 also in this embodiment.

The second surface 16 is set closer to the first surface 5 than the focal point 12 and perpendicular to the traveling direction of the acoustic wave 26 which has been reflected at the outer surface 4. The second surface 16 is convex to the first surface 5. In other words, the second surface 16 being concave to the outside is opposed to the first surface 5 in the acoustic conductor 7. Such a structure allows minimization of the reflectivity of the acoustic wave 26 at the second surface 16 which is a boundary between the acoustic conductor 7 and the ink 30, thereby increasing the focusing efficiency of the acoustic energy in the ink 30.

Particularly in the case that the outer surface 4 is a paraboloid of revolution, it is preferable to set the second surface 16 as a spherical surface centering at the focal point 12. Such a structure allows acoustic wave 26 reflected at any point on the outer surface 4 to have an equal path length from the acoustic conductor 7 to the focal point 12. Therefore, the acoustic wave 26 is focused in phase onto the focal point 12, thereby improving the acoustic energy.

Of course, the outer surface 4 may extend in a direction having a component perpendicular to the sheet of drawing and present a parabola in cross section on the sheet. In that case, the second surface 16 may be formed in an arc shape that is convex to the first surface 5 extending in a direction that the outer surface 4 extends.

Third Preferred Embodiment

Figure 4:
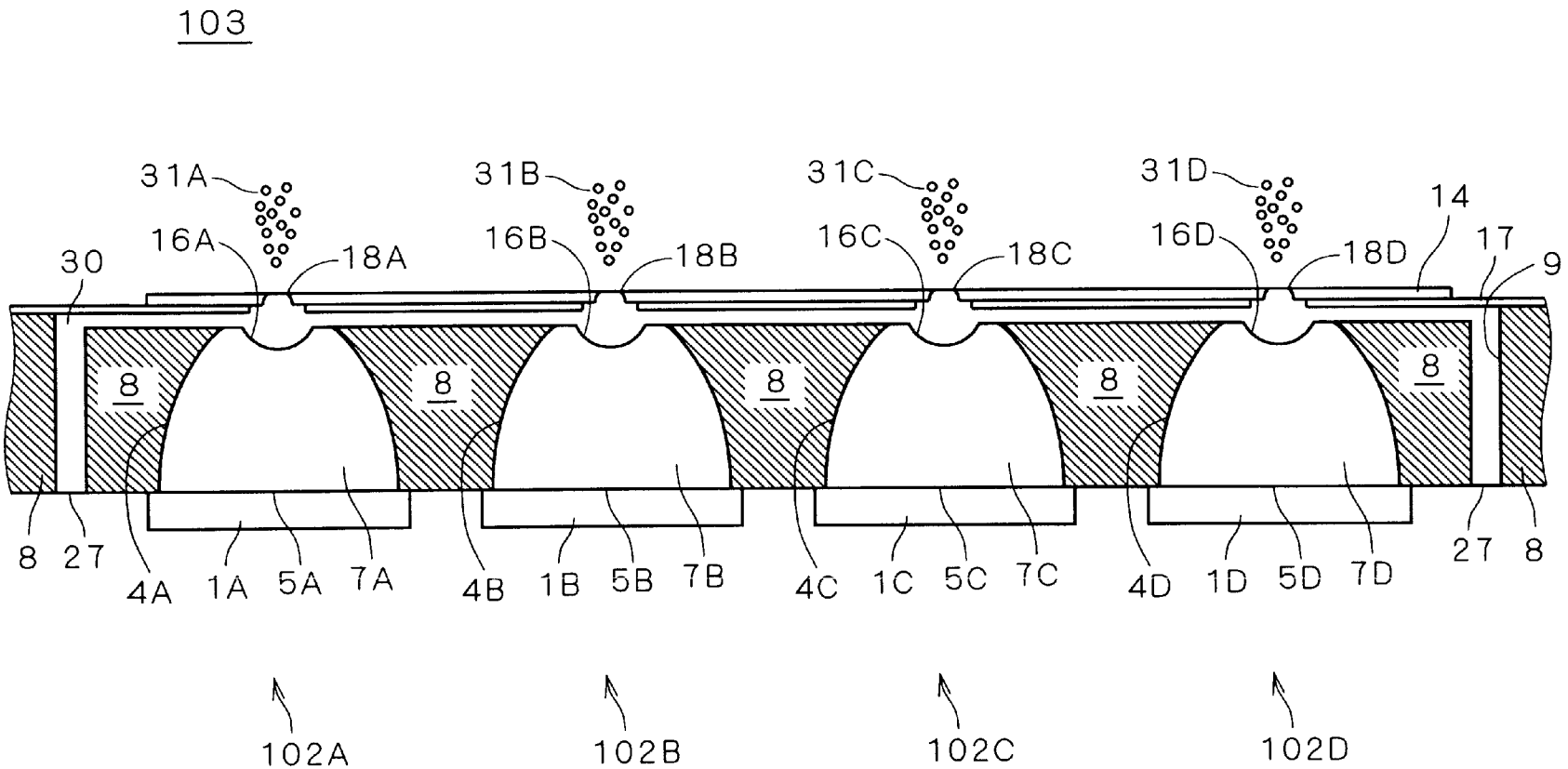
FIG. 4 is a sectional view showing a structure of a liquid ejector according to a third embodiment of the present invention.

FIG. 4 is a sectional view showing a structure of a liquid ejector 103 according to the present embodiment. The liquid ejector 103 has liquid ejectors 102A, 102B, 102C and 102D arranged in parallel with each other in the cross section, each employing the liquid ejector 102 shown in the second embodiment.

Assuming that x comprehensively represents A, B, C and D, liquid ejectors 102*x* comprise vibration excitors 1*x* which can operate individually and acoustic conductors 7*x*. The acoustic conductors 7*x* include first surfaces 5*x*, second surfaces 16*x* and outer surfaces 4*x*. All the acoustic conductors 7*x* are surrounded by a body 8 and commonly covered by the holding plate 17. The outer surfaces 4*x* present, e.g., parabolas in cross section, and focal points of the parabolas are positioned above the second surfaces 16*x*, and the holding plate 17 is opened in the vicinity of the focal points. The supplying path 9 is interposed between the body 8 and the holding plate 17 and supplies the ink 30 commonly to all the liquid ejectors 102*x*. The nozzle plate 14 is provided on the holding plate 17 and has nozzle holes 18*x* placed at the focal points of the parabolas of the outer surfaces 4*x*. Ink droplets 31*x* are ejected from the nozzle holes 18*x*.

This structure, in which the supplying path 9 is provided in common, allows a general supply of the ink 30 without the necessity of supplying the ink 30 for each of the ejectors 102*x*. Moreover, the supplying path 9 extends in a direction that the liquid ejectors 102*x* are arranged, so that the ink 30 is supplied rapidly and smoothly. Therefore, filling the ink 30 into the supplying path 9 with air existing inside is easily conducted without an air bubble remained. Further, the components are used in common, which results in reduction in the number of parts and easy construction. Accordingly, the cost can be reduced.

In the present embodiment, the acoustic conductors 7*x* may extend in a direction having a component perpendicular to the sheet of drawing, or the liquid ejectors 102*x* may be disposed in matrix in the case that the outer surfaces 4*x* present paraboloids of revolution. Of course, the number of the liquid ejectors 102*x* to be disposed is not necessarily four, but any plural number is fine.

Fourth Preferred Embodiment

While the above preferred embodiments exemplify the case that the outer surface 4 mainly presents a parabola in cross section, a surface reflecting the acoustic wave 26 is not limited to such a form in the present invention.

Figure 5:
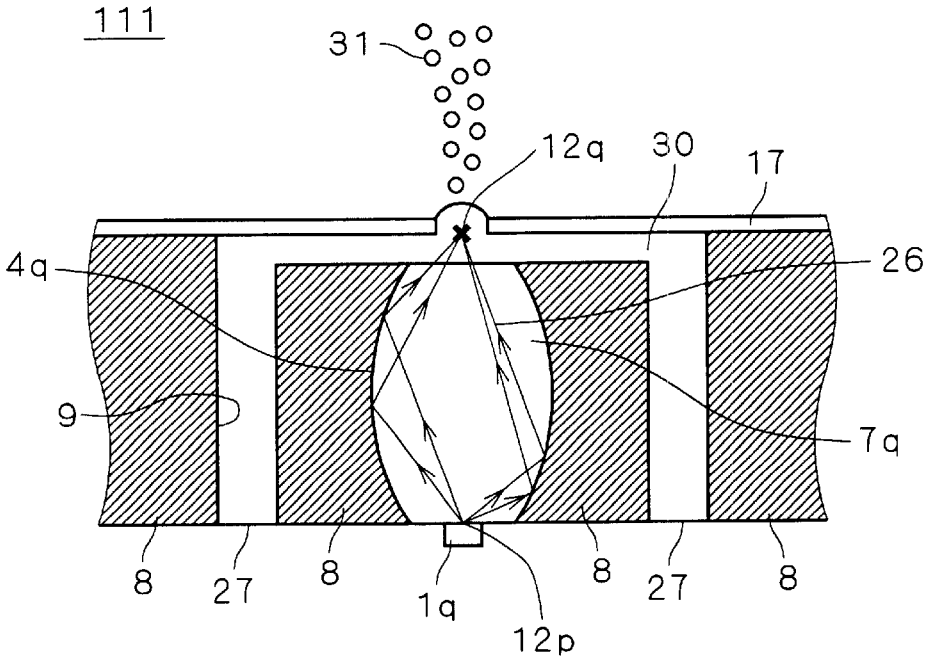
FIG. 5 is a sectional view showing a structure of a liquid ejector according to a fourth embodiment of the present invention.

FIG. 5 is a sectional view exemplifying a liquid ejector according to the present invention in which the outer surface 4 is modified in cross section, taking the first embodiment as an example. The present embodiment is easily applicable to the second and third embodiments.

In a liquid ejector 111 according to the present embodiment, a vibration excitor 1*q* ejects the acoustic wave 26 almost radially in cross section. The vibration excitor 1*q* is, e.g., a point sound source, or a linear sound source extending in a direction having a component perpendicular to the sheet of drawing. An acoustic conductor 7*q* has an outer surface 4*q* presenting an ellipse in cross section. The vibration excitor 1*q* is positioned at a focal point 12*p* of the ellipse and the ink 30 is supplied to another focal point 12*q* of the ellipse through the supplying path 9.

The acoustic wave 26 supplied radially from the vibration excitor 1*q* is focused onto the focal point 12*q* in the above structure as well, and the acoustic energy is increased in the ink 30, which allows the ink droplet 31 to be ejected.

In the case that the ink 30 stored in a vessel has the function of propagating the acoustic wave 26 as in the background art, a blocking plate needs to be provided between the vibration excitor 1*q* and the vessel for preventing the leakage of the ink 30. However, such a blocking plate is unnecessary in the present embodiment by employing solid for the acoustic conductor 7*q*.

Fifth Preferred Embodiment

Figure 6:
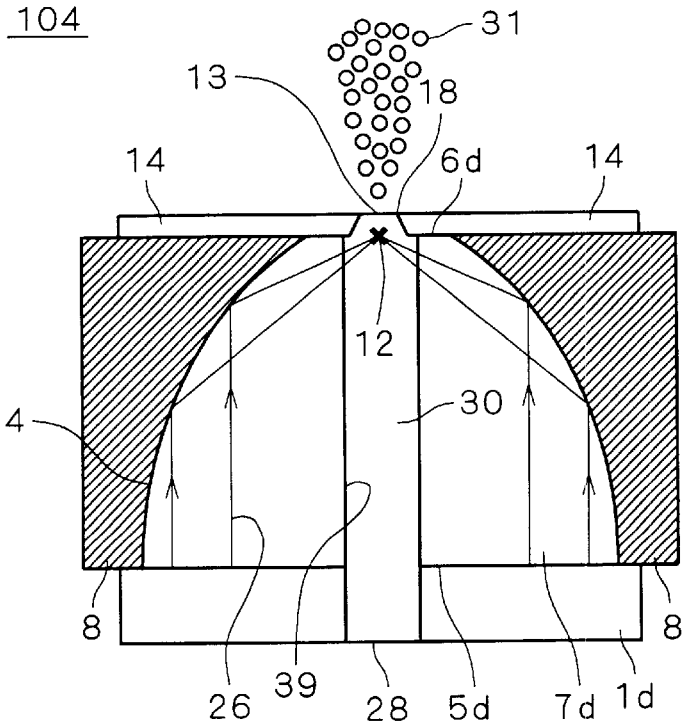
FIG. 6 is a sectional view showing a structure of a liquid ejector according to a fifth embodiment of the present invention.

FIG. 6 is a sectional view showing a structure of a liquid ejector 104 according to the present embodiment. An acoustic conductor 7*d* comprises a first surface 5*d* and a second surface 6*d* which are opposed to each other. A vibration elicitor 1*d* is provided on the first surface 5*d*. The acoustic conductor 7*d* further comprises the outer surface 4 for bridging the first surface 5*d* and the second surface 6*d*. The outer surface 4 has the function of reflecting the acoustic wave 26 given to the first surface 5*d* by the vibration excitor 1*d* and propagated inside the acoustic conductor 7*d* and focusing it onto the vicinity of the second surface 6*d*. The acoustic conductor 7*d* has an inner surface 39 forming a supplying path for supplying the ink 30. The first surface 5*d*, the second surface 6*d* and the vibration excitor 1*d* are divided by the inner surface 39 in cross section. The material for the acoustic conductor 7 may be employed for the acoustic conductor 7*d*.

The first surface 5*d* is, for example, in parallel to and larger than the second surface 6*d*. The outer surface 4 presents, e.g., a parabola in cross section whose axis is a line perpendicular to the first surface 5*d* and the second surface 6*d*. If the first surface 5*d* and the second surface 6*d* are annular, for example, the outer surface 4 presents a paraboloid of revolution. If the first surface 5*d* and the second surface 6*d* extend in a direction having a component perpendicular to the sheet of drawing, the outer surface 4 extends in that direction while having a surface presenting a parabola in the cross section shown in FIG. 6.

For instance, the parabola shown in the cross section of the outer surface 4 has the focal point 12 in the vicinity of the second surface 6*d*. The inner surface 39 is formed to surround the axis of the parabola.

The ink 30 is supplied onto the second surface 6*d* through a supplying path formed by the inner surface 39 (hereinafter also referred to as "supplying path 39"), and the liquid level 13 is set separately from the second surface 6*d* more than the focal point 12. In the present embodiment, the line of intersection of the second surface 6*d* and the inner surface 39 performs the function of the opening 15 in the first preferred embodiment, so that the holding plate 17 is not required. However, in the preferred embodiment shown in FIG. 6, the nozzle plate 14 having the nozzle hole 18 of a diameter smaller than that of the inner surface 39 provided in the vicinity of the focal point 12 is mounted on the second surface 6*d*. The liquid level 13 of the ink 30 is held at the nozzle hole 18. The vibration excitor 1*d* has an opening 28 communicating with the supplying path 39 through which the ink 30 is ejected.

Similarly to the first and second embodiments, the acoustic wave 26 reflected at the outer surface 4 is focused onto the focal point 12 in the present embodiment as well, and the acoustic energy is increased in the ink 30, which allows the ink droplet 31 to be ejected.

The ink 30 is supplied into the supplying path 39 through the opening 28, so that an air bubble hardly appears in the ink 30. Particularly when the inner surface 39 presents a linear form, an air bubble hardly appears owing to the simple form of the supplying path 39.

Moreover, by reducing the inner surface 39 in size so as not to contact with the outer surface 4 of the acoustic conductor 7*d*, in other words, so as to secure the second surface 6*d*, the propagation of the acoustic wave 26 in the acoustic conductor 7*d* is not hardly hampered by the inner surface 39. Therefore, even when an air bubble is present in the ink 30 within the supplying path 39, the focusing of the acoustic wave 26 is not hardly affected unless the bubble is located near the focal point 12.

Further, in the present embodiment, the ink 30 is provided through the supplying path 39 which is on the opposite side of the acoustic conductor 7*d* with respect to the inner surface 39 (also taken as "the outside of the acoustic conductor" in the present specification), so that it is not necessary to provide a mechanism for supplying ink. This can produce reduction in the number of components, and besides, reduction in the costs. This also results in weight reduction and improved transportability. Furthermore, since the liquid ejector 104 can be miniaturized, and thus, the second problem can be solved, allowing insertion into a narrow place.

Sixth Preferred Embodiment

Figure 7:
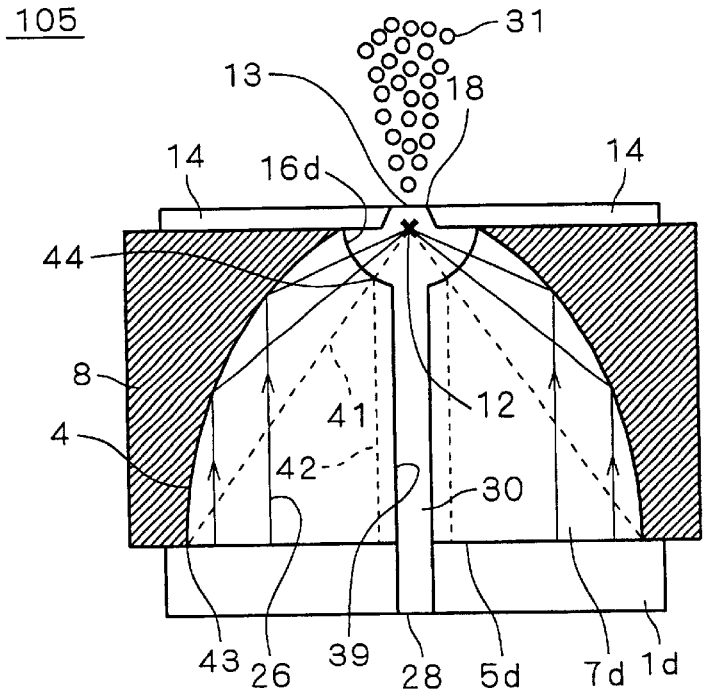
FIG. 7 is a sectional view showing a structure of a liquid ejector according to a sixth embodiment of the present invention.

FIG. 7 is a sectional view showing a structure of a liquid ejector 105 according to the present embodiment. The liquid ejector 105 comprises a second surface 16*d* instead of the second surface 6*d* in the structure of the liquid ejector 104. The second surface 16*d* is also divided by the inner surface 39 in cross section. The focal point 12 is positioned above the second surface 16 in this embodiment as well.

The second surface 16*d* is set closer to the first surface 5*d* than the focal point 12, and perpendicular to the traveling direction of the acoustic wave 26 reflected at the outer surface 4. Therefore, the second surface 16*d* minimizes the reflectivity of the acoustic wave 26 travelling from the acoustic conductor 7*d* to the ink 30 similarly to the second embodiment. This can increase the focusing efficiency of the acoustic energy in the ink 30.

In the case that the outer surface 4 is a paraboloid of revolution, it is preferable to set the second surface 16*d* as a spherical surface centering at the focal point 12 and communicating with the inner surface 39. According to such a structure, the acoustic wave 26 is focused onto the focal point 12 in phase, which increases the acoustic energy.

Of course, the outer surface 4 may extend in a direction having a component perpendicular to the sheet of drawing and present a parabola in cross section on the sheet. In that case, the second surface 16*d* may be formed in an arc shape which is convex to the first surface 5*d* and may extend in a direction that the outer surface 4 extends.

There is a preferable position for the inner surface 39 in the present embodiment. In the cross section where the outer surface 4 presents a parabola, there is assumed a line 41 connecting an intersection 43 of the first surface 5*d* and the outer surface 4 with the focal point 12. There is assumed another line 42 passing through an intersection 44 of the line 41 and the arc of the second surface 16*d* in parallel with the axis of the parabola.

When propagating in the acoustic conductor 7*d* at a position closer to the axis of the parabola than the line 42, the acoustic wave 26 is not reflected at the outer surface 4 and does not contribute to increase in the acoustic energy at the focal point 12 except when propagating along the axis of the parabola. Thus, the inner surface 39 is set in a position closer to the axis of the parabola than the line 42, so that every acoustic wave 26 reflected at the outer surface 4 is focused onto the focal point 12. This can improve the ejection efficiency.

Seventh Preferred Embodiment

Figure 8:
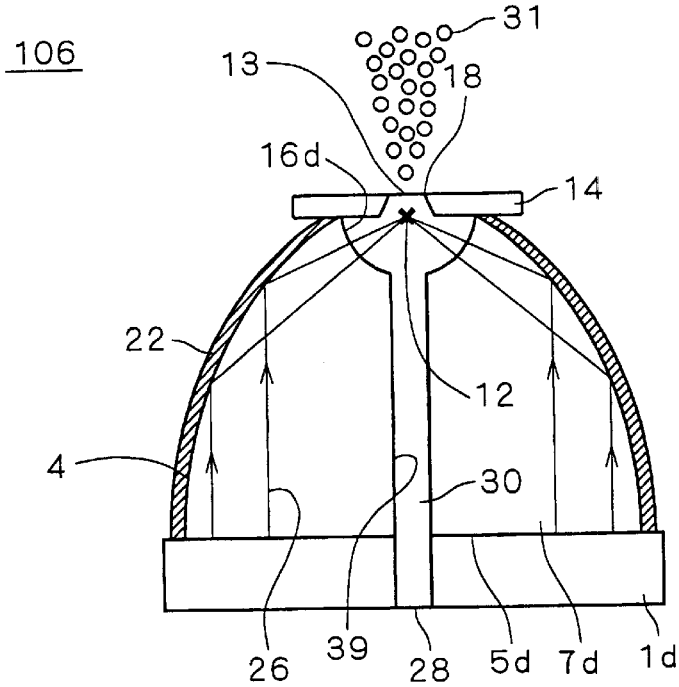
FIG. 8 is a sectional view showing a structure of a liquid ejector according to a seventh embodiment of the present invention.

FIG. 8 is a sectional view showing a structure of a liquid ejector 106 according to the present embodiment. The liquid ejector 106 comprises a coating film 22 instead of the body 8 in the structure of the liquid ejector 105. The coating film 22 covers the outer surface 4 of the acoustic conductor 7*d*. In the present embodiment, the second surface 16*d* may be replaced by the second surface 6*d* as in the liquid ejector 104.

Preferably, the coating film 22 is set to be thicker than the wavelength of the acoustic wave 26 in the acoustic conductor 7*d* and to have an acoustic impedance greatly different from that of the acoustic conductor 7*d*. This causes the coating film 22 to function as a protecting member like the body 8 for easing the acoustic wave 26 from being reflected at the outer surface 4 and preventing the propagation of the acoustic wave 26 from being disturbed from the outside. As shown in FIG. 8, the replacement of the body 8 by the coating film 22 allows reduction in the diameter of the nozzle plate 14. Thus, a tip for ejecting the ink droplet 31 is made narrow, and the Liquid ejector 106 is reduced in size and weight as a whole. This facilitates insertion of the ejector into a narrow place and handling thereof.

Figure 9:
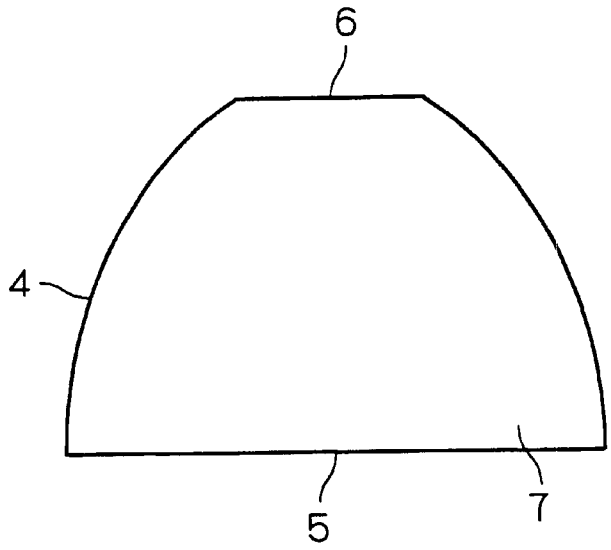
FIGS. 9 through 12 are sectional views showing manufacturing steps of the liquid ejector according to the seventh embodiment.
Figure 10:
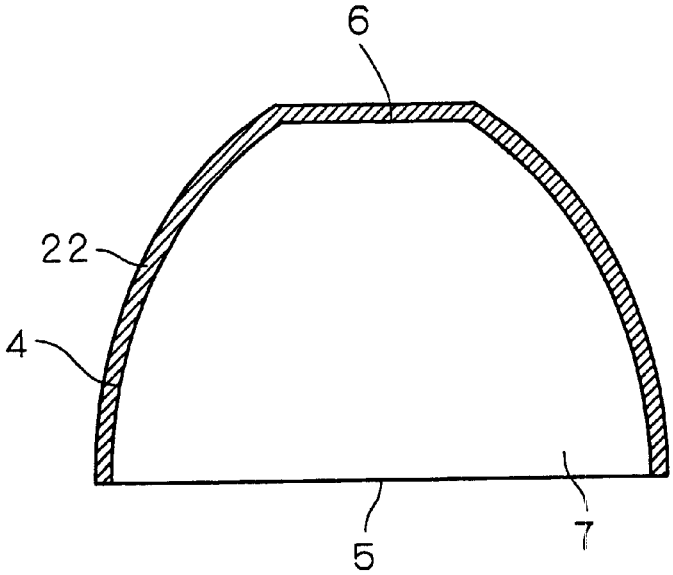
Figure 11:
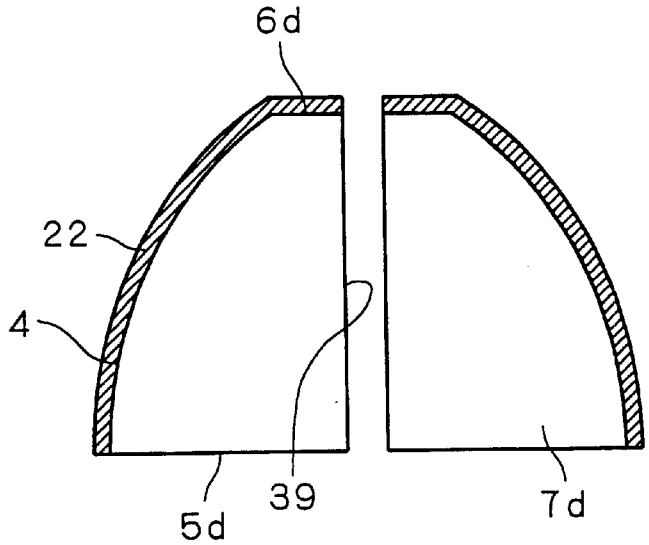
Figure 12:
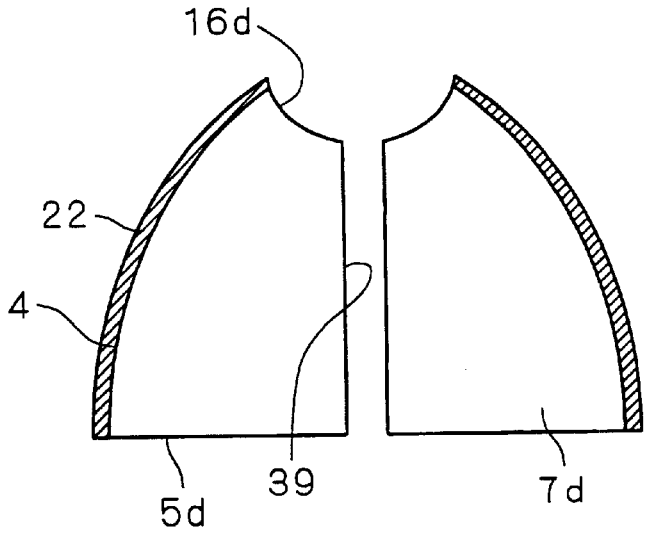

For instance, the coating film 22 may be made of plating. FIGS. 9 through 12 are sectional views showing manufacturing steps of the liquid ejector 106 in order. First, the acoustic conductor 7 having no inner surface 39 is once formed (FIG. 9). Then, its outer surface 4 is plated to obtain the coating film 22. For example, the coating film 22 can be formed on the second surface 6 and the outer surface 4 in such a manner that the first surface 5 should not be in contact with a plating liquid (FIG. 10). Thereafter, the acoustic conductor 7 is processed to form the inner surface 39. The first surface 5 and the second surface 6 are thereby turned to be the first surface 5*d* and the second surface 6*d*, which form the acoustic conductor 7*d* (FIG. 11). The second surface 6*d* is further processed to form the second surface 16*d*. At this process, the coating film 22 is removed except for the outer surface 4 (FIG. 12). Thereafter, the vibration excitor 1 and the nozzle plate 14 are attached to the first surface 5*d* and the second surface 16*d*, respectively, to form the liquid ejector 106.

In this way, the liquid ejector 106 has a simple structure, resulting in simplified manufacturing steps and reduction in manufacturing costs.

Eighth Preferred Embodiment

Figure 13:
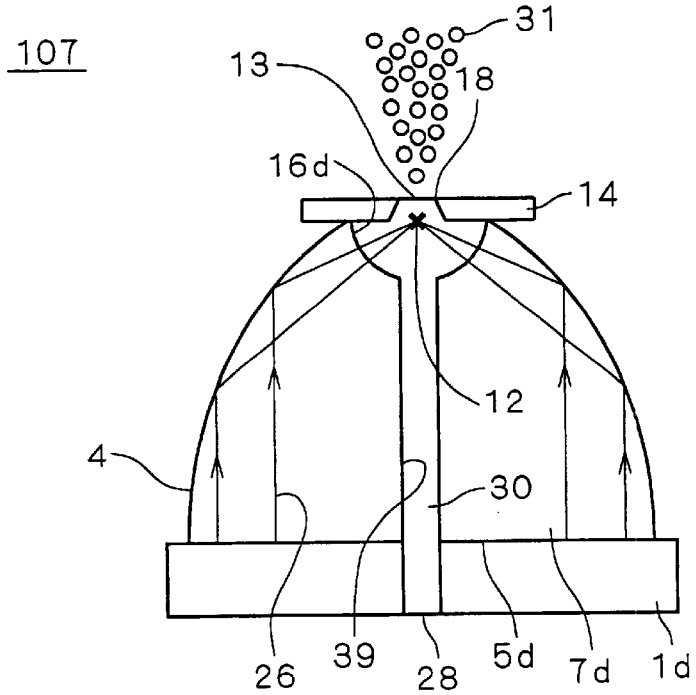
FIG. 13 is a sectional view showing a structure of a liquid ejector according to an eighth embodiment of the present invention.

FIG. 13 is a sectional view showing a structure of a liquid ejector 107 according to the present embodiment. The liquid ejector 107 has the structure of the liquid ejector 106 from which the coating film 22 is removed.

In such a case that there is no coating film 22, the outer surface 4 of the acoustic conductor 7*d* is in contact with an area such as air that has an acoustic impedance greatly different from that of the acoustic conductor 7*d*. Therefore, the acoustic wave 26 propagating in the acoustic conductor 7 is reflected at the outer surface 4 in this case as well. Thus, a tip for ejecting the ink droplet 31 can be made narrow as in the liquid ejector 106, resulting in reduction in size and weight as a whole.

In the liquid ejector 107, it is a preferable embodiment that the acoustic conductor 7*d* is made of metal. Even in the case that an acoustic impedance around the outer surface 4 is higher than that of air, the reflectivity of the acoustic wave at the outer surface 4 can be held large. When the ejector is inserted into a narrow place, the acoustic wave 26 is satisfactorily reflected at the outer surface 4, even if there is a material being in contact with the acoustic conductor 7*d* from the outside, provided that the material has an acoustic impedance lower than that of metal. Further, the propagating acoustic wave 26 has a low attenuation compared to the case of forming the acoustic conductor 7*d* of resin, which produces increase in the ejection efficiency. There is still further advantage that higher intensity is obtained.

Ninth Preferred Embodiment

When the acoustic conductor 7*d* is made of metal as has been described, the focusing diameter tends to be large. This is because the wavelength of acoustic wave in metal is longer than that in liquid or resin. Thus, it is preferable to provide a mechanism for further focusing the acoustic wave already focused onto a focal point.

Figure 14:
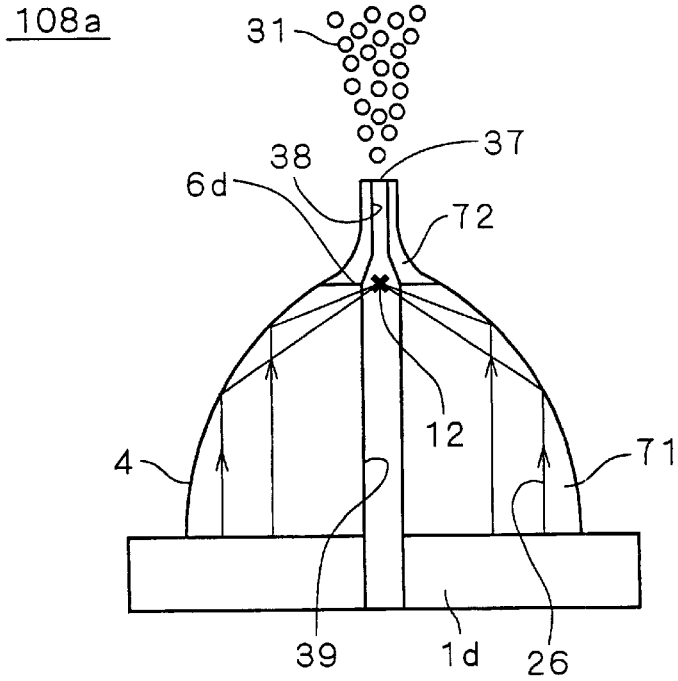
FIG. 14 is a sectional view showing a structure of a liquid ejector according to a ninth embodiment of the present invention.

FIG. 14 is a sectional view showing a structure of a liquid ejector 108*a* according to the present embodiment. The liquid ejector 108*a* comprises an acoustic conductor 71 and a horn 72 instead of the acoustic conductor 7*d* and the nozzle plate 14, respectively, in the structure of the liquid ejector 107.

Specifically, the acoustic conductor 71 differs from the acoustic conductor 7*d* only in that its material is limited to metal. Mounted on the second surface 6 of the acoustic conductor 71 is the horn 72 having an acoustic impedance almost equal to that of the acoustic conductor 71 and made of, for example, the same material as the acoustic conductor 71. The horn 72 has a channel 38 pierced for communicating with the supplying path 39 in the acoustic conductor 71. The larger diameter of the horn 72 abuts against the second surface 6*d*, and the ink droplet 31 is ejected from an opening 37 of the channel 38 on the side of the smaller diameter of horn 72. That is, the horn 72 has an outer surface with a diameter decreasing from the focal point 12 toward the opening 37.

In the liquid ejector 108*a*, the acoustic conductor 71 and the horn 72 are made of metal, which are therefore superior in intensity, and the acoustic wave 26 propagates therein with a low attenuation. Further, the vicinity of the opening 37 for ejecting the ink droplet 31 is narrow owing to the shape of the horn 72, which results in an easy insertion into a narrow place. The acoustic wave 26 focused onto the focal point 12 is further reduced in the focusing diameter, thereby increasing the acoustic energy at the opening 37.

In order to prevent interference of the acoustic wave in the horn 72, the horn 72 preferably has its larger diameter set almost equal to and not larger than the wavelength of the acoustic wave 26 in the acoustic conductor 71 and the horn 72. The channel 38 may be formed wide on the side of the larger diameter of the horn 72 and narrow in the vicinity of the opening 37.

Figure 15:
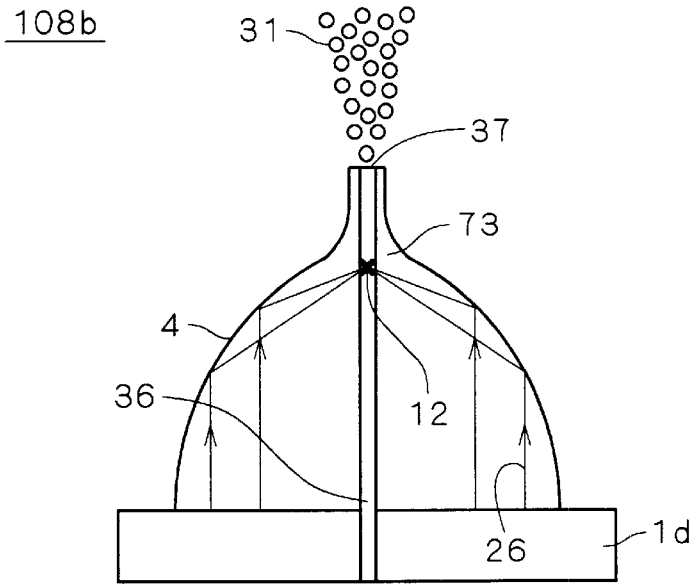
FIG. 15 is a sectional view showing a structure of a modification of the liquid ejector according to the ninth embodiment.

FIG. 15 is a sectional view showing a structure of a liquid ejector 108*b* according to a modification of the present embodiment. The liquid ejector 108*b* employs an acoustic conductor 73 in which the acoustic conductor 71 and the horn 72 of the liquid ejector 108*a* are formed integrally. A channel 36, which corresponds to the supplying path 39 and the channel 38 communicating with each other in the liquid ejector 108*a*, may have a uniform diameter from the side of the vibration excitor 1*d* to the opening 37. Alternatively, it may have a diameter wider on the side of the vibration excitor 1*d* than that of the opening 37 similarly to the liquid ejector 108*a*. This makes it easier to form the channel 36.

Figure 16:
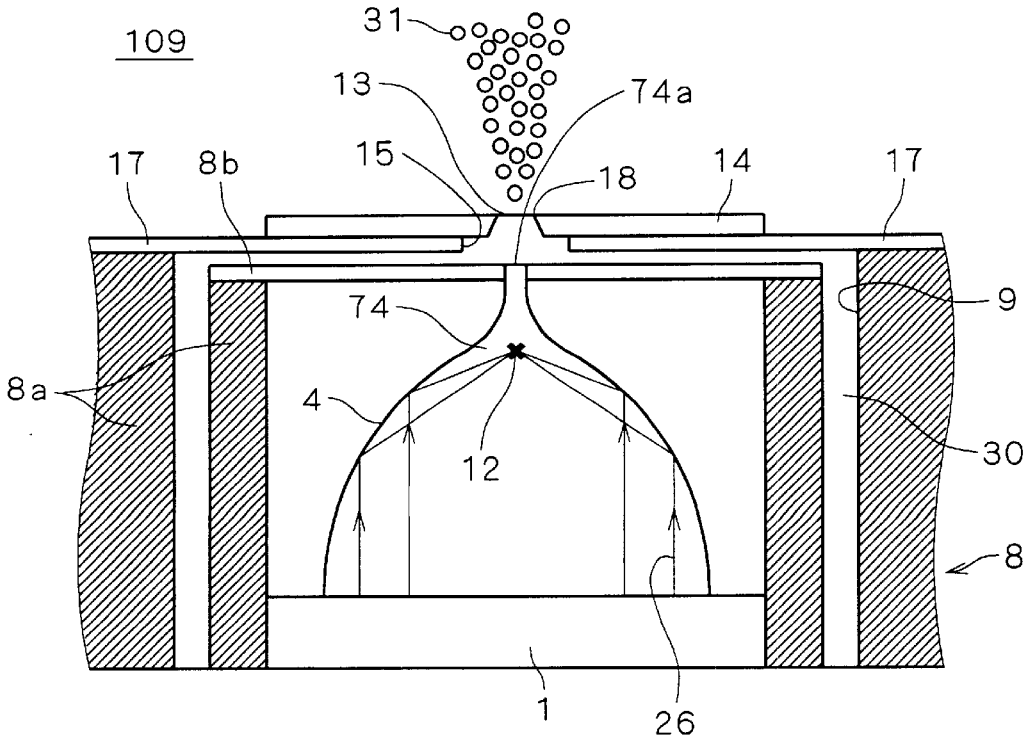
FIG. 16 is a sectional view showing a structure of another modification of the liquid ejector according to the ninth embodiment.

FIG. 16 is a sectional view showing a structure of another modification of the liquid ejector 109 according to the present embodiment. The liquid ejector 109 comprises an acoustic conductor 74. The acoustic conductor 74 has the structure of the acoustic conductor 73 in which the channel 36 is not pierced.

The acoustic wave 26 is supplied to the acoustic conductor 74 from the vibration excitor 1 similarly to the liquid ejector 101. The acoustic wave 26 is reflected at the outer surface 4 of the acoustic conductor 74 and focused once onto the focal point 12. Thereafter, it propagates further to a tip 74*a* of the acoustic conductor 74 and is focused.

The ink 30 is supplied to the tip of the acoustic conductor 74 through the supplying path 9 formed by the body 8 similarly to the liquid ejector 101. The holding plate 17 is mounted for holding the liquid level of the ink 30, and the nozzle plate 14 is mounted thereon. Thus, the acoustic wave 26 focused onto the tip 74*a* increases the acoustic energy of the ink 30 on the tip 74*a*, thereby ejecting the ink droplet 31 from the ink 30.

In the liquid ejector 109, different from the liquid ejector 101, the body 8 and the acoustic conductor 74 are both made of metal, and when they come into contact with each other, the acoustic wave 26 is easy to leak from the acoustic conductor 74 into the body 8 through the outer surface 4. Thus, in the present embodiment, the body 8 includes a first portion 8*a* provided separately from and around the acoustic conductor 74, and a top plate 8*b* leading the ink 30 to the tip 74*a* and having a hole which exposes at the tip 74*a*, both arranged not to be in contact with the outer surface 4. A seal member may be provided at the exposed part to prevent leakage of the ink 30. If the opening 15 of the holding plate 17 has a diameter large enough to hold the liquid level of the ink 30, the ink droplet 31 can be ejected without providing the nozzle plate 14.

The liquid ejector 109, in which the body 8 is provided outside the acoustic conductor 74, is likely to be increased in size compared to the liquid ejectors 108*a* and 108*b*. However, it is not necessary to pierce the channels 36, 38 and the supplying path 39, resulting in an easy fabrication of the acoustic conductor 74 compared to the acoustic conductors 71, 73 and the horn 72. Additionally, a plurality of liquid ejectors 109 may be arranged easily as shown in FIG. 4.

Tenth Preferred Embodiment

Figure 17:
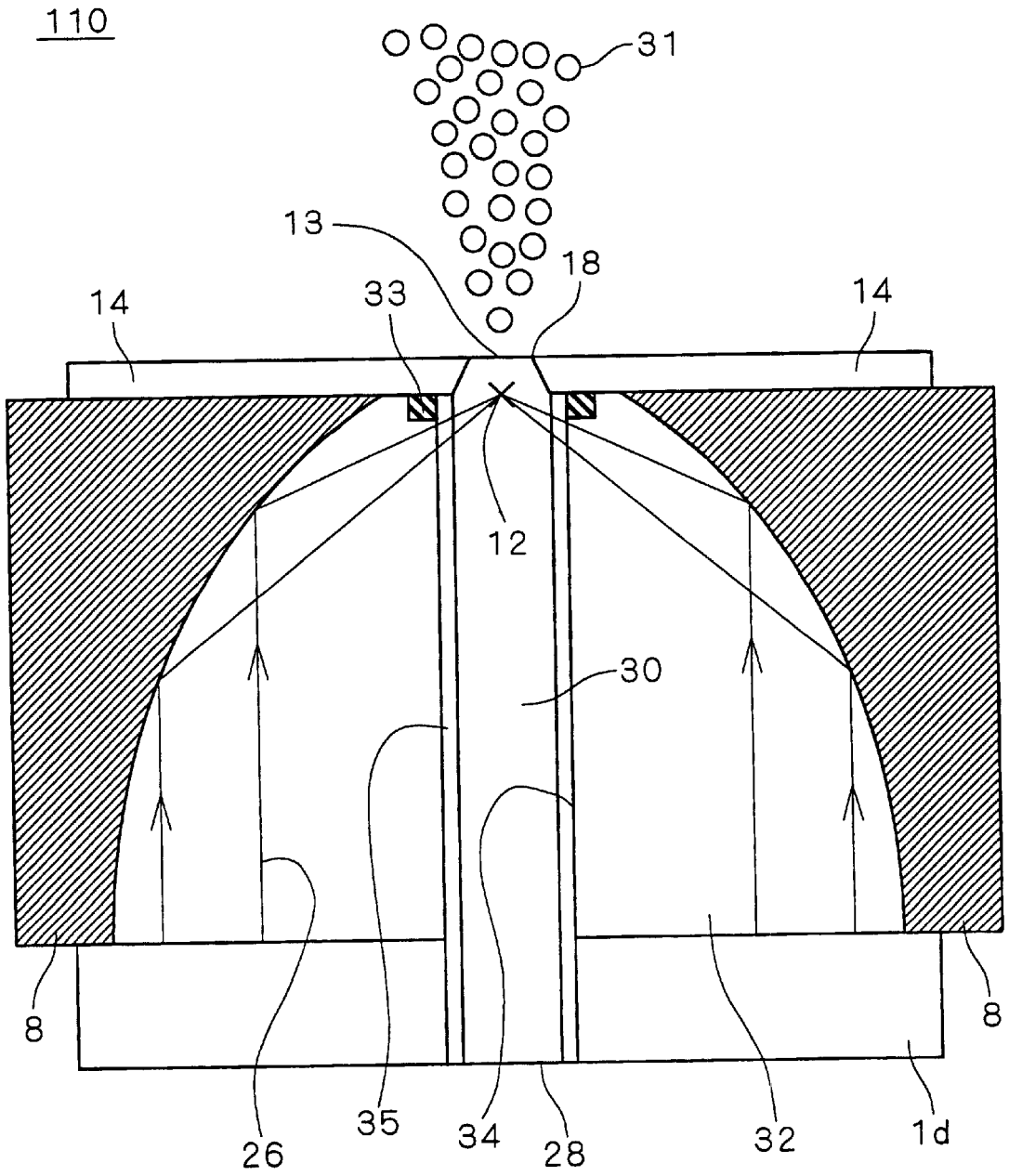
FIG. 17 is a sectional view showing a structure of a liquid ejector according to a tenth embodiment of the present invention.
Figure 18:
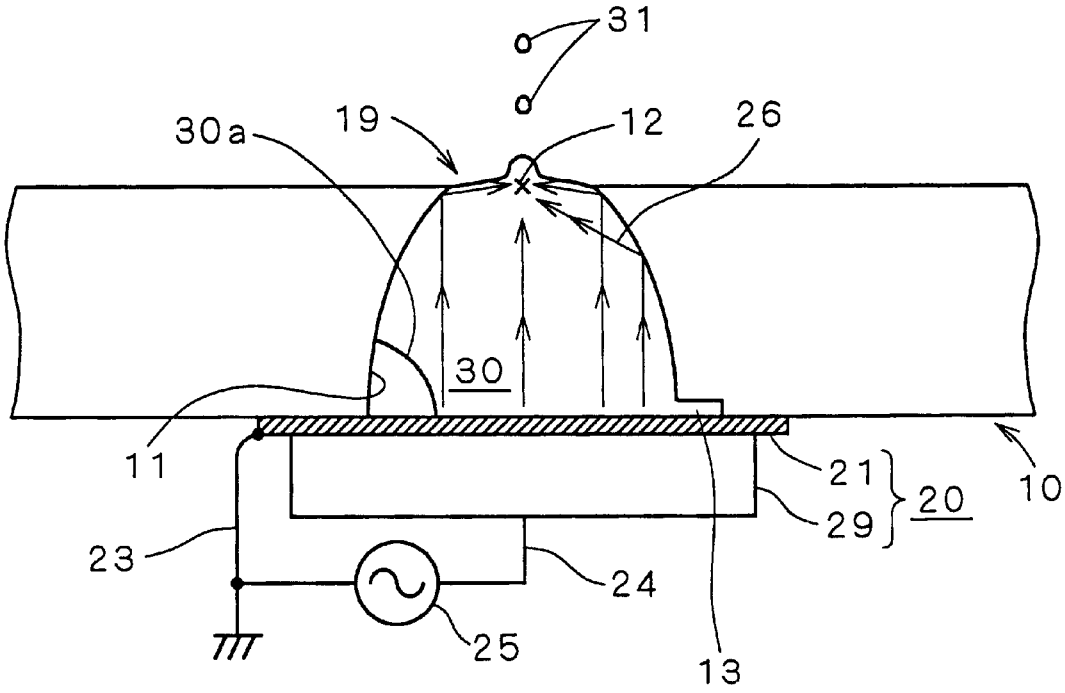
FIG. 18 is a sectional view showing the background art.

FIG. 17 is a sectional view showing a structure of a liquid ejector 110 according to the present embodiment. The liquid ejector 110 comprises a liquid-filled member 32 instead of the acoustic conductor 7*d* in the structure of the liquid ejector 104 shown by FIG. 6 in the fifth embodiment. Preferably, the liquid-filled member 32 is acoustically low in attenuation similarly to the acoustic conductors 7 and 7*d*, and besides, it has an acoustic impedance close to that of the ink 30.

In order to prevent mixing of the liquid-filled member 32 and the ink 30, a channel tube 35 is provided which has the opening 28 and abuts against the nozzle plate 14 passing through the vibration excitor 1*d*. The ink 30 is supplied to the nozzle 18 from the opening 28 through the channel tube 35. That is, it can be said that the ink 30 is provided from the opposite side of the liquid-filled member 32 with respect to the channel tube 35 (also taken as "the outside of the acoustic conductor" in the present specification). In order to prevent the liquid-filled member 32 and the ink 30 from being mixed, it is preferable to provide a seal 33 at the part where the nozzle plate 14 and the channel tube 35 abut against each other. The seal 33 may be provided around the channel tube 35 as illustrated, or may be provided on a tip of the channel tube 35 so that the channel tube 35 abuts against the nozzle plate 14 with the seal 33 interposed therebetween.

In the liquid ejector 110, the outer surface 4 of the liquid-filled member 32 is defined by an inner wall of the body 8. In other words, the inner wall of the body 8 presents a form such as a parabola in cross section that focuses the acoustic wave 26 onto the focal point 12. An inner surface 34 of the liquid-filled member 32 is defined by an outer surface of the channel tube 35. That is, the liquid-filled member 32 is filled in between the body 8 and the channel tube 35. Preferably, the outer surface of the channel tube 35 is not in contact with the inner wall of the body 8 similarly to the inner surface 39 of the acoustic conductor 7*d*. Further, the body 8 is preferably thicker than the wavelength of the acoustic wave 26 in the liquid-filled member 32.

In the liquid ejector 110, the acoustic wave 26 is given to the liquid-filled member 32 from the vibration excitor 1*d*. Further, it is reflected at the outer surface 4 of the liquid-filled member 32 defined by the inner wall of the body 8, ;and is focused onto the focal point 12 in the ink 30 inside the tube 35, passing through the channel tube 35. Therefore, it is preferable to make the channel tube 35 of a material having few acoustic losses, and the materials exemplified as those for the acoustic conductors 7 and 7*d* may be employed, for example.

The liquid ejector 110 achieves the effect similar to that of the liquid ejector 104. In addition, the liquid-filled member 32 may be made of the same material as the ink 30. This can result in reduction of the reflection and attenuation when the acoustic wave 26 is made incident into the ink 30, thereby improving the ejection efficiency.

While the invention has been shown and described in detail, the foregoing description is in all aspects illustrative and not restrictive. It is therefore understood that numerous modifications and variations can be devised without departing from the scope of the invention.

What is claimed is:

1. A liquid ejector comprising:

at least one acoustic conductor including a solid material for propagating acoustic wave, said at least one acoustic conductor including a first surface which is provided with said acoustic wave from the outside and an outer surface configured to focus said acoustic wave at a focal point; and a supplying passage for supplying liquid to be ejected from the outside of said acoustic conductor to said focal point.

2. The liquid ejector according to claim 1, wherein:

said outer surface of said at least one acoustic conductor forms a parabola having said focal point as a focus in a cross-section; and said acoustic wave is supplied such that said acoustic wave travels in parallel with an axis of said parabola.

3. The liquid ejector according to claim 1, wherein:

said outer surface presents an ellipse having said focal point as a first focus in a cross-section; and said acoustic wave is supplied radially at a second focus of said ellipse.

4. The liquid ejector according to claim 1, wherein said supplying passage is arranged outside said outer surface.

5. The liquid ejector according to claim 4, wherein:

said at least one acoustic conductor comprises a plurality of acoustic conductors; and said supplying path is used in common for said plurality of acoustic conductors.

6. The liquid ejector according to claim 5, wherein said supplying passage extends in a direction that said plurality of acoustic conductors are arranged.

7. The liquid ejector according to claim 4, wherein, said at least one acoustic conductor further comprises a second surface arranged closer to said first surface than said focal point, and a boundary between said liquid to be ejected and said second surface is perpendicular to a traveling direction of said acoustic wave which has been reflected at said outer surface.

8. The liquid ejector according to claim 7, wherein:

said outer surface presents a parabola having said focal pont as a focus in a cross-section; and said second surface presents an arc shape which is a convex with respect to said first surface.

9. The liquid ejector according to claim 1, further comprising a protecting member being in contact with said outer surface of said at least one acoustic conductor and having an acoustic impedance larger than that of said at least one acoustic conductor.

10. A liquid ejector comprising:

at least one acoustic conductor for propagating acoustic wave, said at least one acoustic conductor including a first surface which is provided with said acoustic wave from the outside and an outer surface configured to focus said acoustic wave at a focal point;

a supplying passage for supplying liquid to be ejected from the outside of said acoustic conductor to said focal point; and a protecting member being in contact with said outer surface of said at least one acoustic conductor and having an acoustic impedance larger than that of said at least one acoustic conductor, wherein said protecting member is thicker than the wavelength of said acoustic wave in said at least one acoustic conductor.

11. The liquid ejector according to claim 1, wherein said outer surface has a diameter decreasing from said focal point toward an opening for ejecting said liquid.

12. The liquid ejector according to claim 1, further comprising a vibration excitor configured to provide said first surface with said acoustic wave.

13. The liquid ejector according to claim 12, wherein said vibration excitor comprises a piezoelectric transducer.

14. A liquid ejector comprising:

at least one acoustic conductor for propagating acoustic wave, said at least one acoustic conductor including a first surface which is provided with said acoustic wave from the outside and an outer surface configured to focus said acoustic wave at a focal point; and a supplying passage for supplying liquid to be ejected from the outside of said acoustic conductor to said focal point, wherein:

said at least one acoustic conductor further comprises an inner surface separated from said outer surface; and said supplying passage is formed by said inner surface.

15. The liquid ejector according to claim 14, wherein:

said at least one acoustic conductor further comprises a second surface arranged closer to said first surface than said focal point; and a boundary between said liquid and said second surface is perpendicular to a traveling direction of said acoustic wave reflected by said outer surface.

16. The liquid ejector according to claim 15, wherein:

said outer surface of said at least one acoustic conductor presents a parabola having said focal point as a focus in a cross-section; and said second surface presents an arc shape which is a convex with respect to said first surface.

17. The liquid ejector according to claim 16, wherein, in said cross-section:

an intersection of said first surface and said parabola is taken as a first intersection;

an intersection of said arc shape and a line connecting said first intersection with said focus of said parabola is taken as a second intersection; and said inner surface is positioned closer to said axis than a line passing through said second intersection in parallel with said axis.

18. The liquid ejector according to claim 14, wherein:

said outer surface presents a parabola having said focal point as a focus in a cross-section; and said inner surface is provided in the vicinity of an axis of said parabola.

19. The liquid ejector according to claim 13, wherein said inner surface presents a line in said cross-section of said at least one acoustic conductor.

* * * * *